US007755545B2

(12) United States Patent
Takei et al.

(10) Patent No.: US 7,755,545 B2
(45) Date of Patent: Jul. 13, 2010

(54) ANTENNA AND METHOD OF MANUFACTURING THE SAME, AND PORTABLE WIRELESS TERMINAL USING THE SAME

(75) Inventors: Ken Takei, Kawasaki (JP); Tomoyuki Ogawa, Hitachi (JP); Morihiko Ikegaya, Kasumigaura (JP); Keisuke Fukuchi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 10/578,769

(22) PCT Filed: Jul. 29, 2004

(86) PCT No.: PCT/JP2004/011193

§ 371 (c)(1),
(2), (4) Date: Jan. 29, 2007

(87) PCT Pub. No.: WO2005/048404

PCT Pub. Date: May 26, 2005

(65) Prior Publication Data

US 2007/0139270 A1 Jun. 21, 2007

(30) Foreign Application Priority Data

Nov. 13, 2003 (JP) ..... 2003-383647

(51) Int. Cl.
*H01Q 1/24* (2006.01)

(52) U.S. Cl. ..... 343/702; 343/700 MS

(58) Field of Classification Search ..... 343/702, 343/700 MS

See application file for complete search history.

(56) References Cited

U.S. PATENT DOCUMENTS 6,292,144 B1 * 9/2001 Taflove et al. ..... 343/702

(Continued)

FOREIGN PATENT DOCUMENTS

CN 2541958 Y 4/2002

(Continued)

OTHER PUBLICATIONS

U.S. Appl. No. 10/525,378, filed Oct. 15, 2002, Takei.

(Continued)

*Primary Examiner*—Douglas W Owens
*Assistant Examiner*—Dieu Hien T Duong
(74) *Attorney, Agent, or Firm*—Stites & Harbison PLLC; Juan Carlos A. Marquez, Esq.

(57) ABSTRACT

A small antenna operating in multiple modes including three or more modes. There are provided an antenna that includes a ground conductor having a ground potential, a single feeding point whose one end is formed by a part of the ground conductor, and a plurality of transmission lines to which RF power supplied to the feeding point is input, the transmission lines each radiating electromagnetic waves of three frequencies of three modes into space. These transmission lines comprises a transmission line 41 that is connected to the feeding point at one end and to a branching point at the other end, a transmission line connected between branching points, and transmission lines connected to the branching points. The lengths of the respective transmission lines are set so that impedance matching is performed at the feeding point with respect to a plurality of frequencies. The antenna is formed from an integrated metal plate.

13 Claims, 12 Drawing Sheets

U.S. PATENT DOCUMENTS

| | | | | |
|---|---|---|---|---|
| 6,600,449 | B2 * | 7/2003 | Onaka et al. | 343/700 MS |
| 6,611,235 | B2 * | 8/2003 | Barna et al. | 343/702 |
| 6,894,647 | B2 * | 5/2005 | Jenwatanavet | 343/700 MS |
| 6,937,200 | B2 | 8/2005 | Takei | |
| 7,015,862 | B2 | 3/2006 | Takei et al. | |
| 2002/0163470 | A1 * | 11/2002 | Nagumo et al. | 343/700 MS |

FOREIGN PATENT DOCUMENTS

| | | | |
|---|---|---|---|
| EP | 1 553 659 | A1 | 10/2002 |
| JP | 05-037226 | | 7/1991 |
| JP | 2000-68736 | | 8/1998 |
| JP | 2003-101326 | | 9/2001 |
| JP | 2003-152430 | | 11/2001 |
| JP | 2003-158419 | | 11/2001 |
| JP | 2003-298346 | | 4/2002 |
| JP | 2005-039394 | | 7/2003 |
| JP | 2005-150876 | | 11/2003 |
| WO | WO 2004/036687 | A1 | 10/2002 |

OTHER PUBLICATIONS

International Search Report of PCT/JP2004/011193 mailed Nov. 2, 2004.

Office Action from the Japanese Patent Office dated Jan. 20, 2009 with English Translation.

Office Action from the China Patent Office dated Sep. 25, 2009 with English Translation.

Notice of Reason(s) for Refusal from the Japanese Patent Office dated Jan. 12, 2010, in Japanese with partial English Translation.

* cited by examiner

ANTENNA AND METHOD OF MANUFACTURING THE SAME, AND PORTABLE WIRELESS TERMINAL USING THE SAME

FIELD OF THE INVENTION

The present invention relates to an antenna of a wireless terminal for providing multimedia services to the user. More specifically, the present invention relates to a multi-mode antenna suitable for use in a multimedia wireless terminal for performing plural services through information transmission using electromagnetic waves of different frequencies as the medium, a method of manufacturing the antenna, and a portable wireless terminal using the antenna.

BACKGROUND OF THE INVENTION

Recent years have seen increasing use of multimedia services in which various services relating to information transmission or information provision are provided by use of radio. Numerous wireless terminals have been developed to this end and put into practical use. The applications of these services have become increasingly diversified to include telephones, televisions, LANs (Local Area Networks), and so on. To enjoy all of these services, the user is required to own the wireless terminal corresponding to the respective services.

With a view to achieving greater convenience for the user to enjoy these services, moves have been started to provide multimedia services to the user whenever and wherever without making the user aware of the presence of the media, that is, in a ubiquitous manner. In this regard, a so-called multi-mode terminal, which realizes the provision of plural information transmission services by means of a single terminal, has been partially realized.

An ordinary ubiquitous information transmission service by radio uses electromagnetic waves as the transmission medium. Accordingly, within the same service area, one frequency is used for one kind of service, thereby allowing provision of plural kinds of services to the user. A multimedia terminal has thus the function of transmitting and receiving electromagnetic waves of plural frequencies.

According to a method adopted in conventional multimedia terminals, for example, plural single-mode antennas each corresponding to one frequency are prepared, and these antennas are mounted to a single wireless terminal. With this method, in order to operate the respective single-mode antennas independently, these antennas must be mounted while being spaced from each other at a distance substantially corresponding to the wavelength. In this regard, the frequencies of the electromagnetic waves used for typical ubiquitous information transmission services are limited to the range of several hundred MHz to several GHz due to the restrictions associated with the free space propagation phenomena, so the distance between neighboring antennas becomes several tens of cm to several m. The dimensions of the terminal thus become large, which detracts from the convenience in terms of portability for the user. Further, due to the spaced arrangement of the antennas having sensitivities to different frequencies, the RF circuits to be connected to the antennas must be also installed while being separated from each other in correspondence with each of these frequencies.

It is thus difficult to employ the semiconductor integrated circuit technique, which may result not only in an increase in the dimension of the terminal but also an increase in the cost of the RF circuit. When the integrated circuit technique is forcefully applied to achieve higher integration of the overall circuit, there arises the need to provide the connection between the RF circuit and each individual antenna placed at a distance therefrom by means of an RF cable. Incidentally, the radius of the RF cable applicable to a terminal of a size that can be carried by the user is in the vicinity of 1 mm. Accordingly, currently, the transmission loss of the RF cable reaches several dB/m. Due to the use of such an RF cable, the electric power consumed by the RF circuit increases, which causes a marked reduction in the time for which the terminal providing ubiquitous information services can be used or a marked increase in the terminal weight due to the increased battery volume, thus seriously impairing the convenience of the user using the terminal.

One of the important elements for overcoming these problems associated with the multi-mode wireless terminal that provides multiple information services to the user is a multi-mode antenna having sensitivity to electromagnetic waves of plural frequencies. There have been proposed several multi-mode antennas having a single antenna structure and a single feeding point meeting to plural frequencies, in which electrical connection with an RF circuit portion of the multi-mode terminal is made to enable transmission/reception of a communication signal between the free space and the RF circuit portion.

Examples of conventional multi-mode antennas include, for example, the two-mode antenna disclosed in Japanese Patent Laid-Open No. 2003-101326 (Document 1). In this antenna, a part of a conducting plate is removed to form a U-shaped slit, with an L-shaped conductor being added into the U-shaped slit. The U-shaped slit operates at a first frequency, and mainly the L-shaped conductor operates at a second frequency. The electromagnetic radiation mechanism in each frequency range is accomplished by mutually perpendicular radiation elements including respective structures.

As another example of a conventional two-mode antenna, Japanese Patent Laid-Open No. 2003-15243 (Document 2) describes an antenna having two opposing linear conductors formed in the inner portion of a conductor having a slit. Each linear conductor also operates as a feeding line of the slit, and transmission/reception of electromagnetic waves of different frequencies is performed between the slit and the feeding line. The principle of operation is the same as that of Document 1.

SUMMARY OF THE INVENTION

In the conventional multi-mode antenna as described above, in order to allow efficient radiation of the electromagnetic waves to the free space at different frequencies, plural radiation conductors operating substantially independently with relatively little mutual interference are arranged perpendicularly to each other. It is thus necessary to adopt an antenna structure in which the slit and the linear conductor are formed separately from each other so as to operate independently at different frequencies. Accordingly, as the frequencies of the electromagnetic waves to be radiated increase, the number of such independent structures increase, which makes it extremely difficult to suppress the overall dimension or volume of the multi-mode antenna small. Indeed, Documents 1, 2 do not disclose a multi-mode antenna of three or more modes.

An object of the present invention is to provide a small multi-mode antenna for realizing an inexpensive and small multimedia wireless terminal, in particular, an antenna that operates in multiple modes of not only two but also three or more modes, a method of manufacturing the antenna, and a portable wireless terminal incorporating the antenna.

In order to attain the above-mentioned object, according to the present invention, there is provided an antenna that includes a ground conductor having a ground potential, a single feeding point whose one end is formed by a part of the ground conductor, and a plurality of transmission lines to which RF power supplied to the feeding point is input, for radiating electromagnetic waves of a plurality of frequencies into space, wherein the plurality of transmission lines include a transmission line for radiating electromagnetic waves of a plurality of frequencies commonly into space, and wherein impedance matching is performed at the feeding point with respect to the plurality of frequencies.

In order to attain the above-mentioned object, according to the present invention, there is also provided an antenna that includes a ground conductor having a ground potential, a single feeding point whose one end is formed by a part of the ground conductor, and a plurality of transmission lines to which RF power supplied to the feeding point is input, for radiating electromagnetic waves of a plurality of frequencies into space, wherein the plurality of transmission lines include a transmission line for radiating electromagnetic waves of a plurality of frequencies commonly into space, wherein, when the plurality of frequencies are composed of two frequencies, the plurality of transmission lines include a first transmission line whose one end is connected to the feeding point and whose other end is connected to a first branching point, and a second transmission line connected to the first branching point, wherein, when the plurality of frequencies are composed of more than three frequencies, the plurality of transmission lines include a third transmission line whose one end is connected to the feeding point and whose other end is connected to a second branching point, a fourth transmission line connected between the second branching point and a third branching point, and a fifth transmission line connected to the third branching point, and wherein respective lengths of the plurality of transmission lines are set so that impedance matching is performed at the feeding point with respect to the plurality of frequencies.

The antenna according to the present invention including the plural transmission lines as its components include transmission lines for radiating electromagnetic waves into free space commonly in plural frequency bandwidths, and these plurality of transmission lines form a distributed constant matching circuit for realizing impedance matching at respective operating frequencies of the multi-mode with respect to the single feeding point.

By regarding the electromagnetic energy radiated into free space from the transmission lines as the energy lost by the distributed constant circuit composed of the transmission lines, and regarding this as the loss, the impedance matching conditions with respect to the single feeding point at respective operating frequencies of the multi-mode antenna can be designed by expanding the common distributed constant circuit theory. With the antenna according to the present invention, instead of embedding plural antenna structures operating at different frequencies within a small volume as in conventional antennas, electromagnetic energy is radiated in a non-local manner in each frequency bandwidth in which the antenna is to be operated from the entire structure composed of the plural transmission lines. Then, the impedance matching between the free space and the RF circuit portion connected to the feeding point of the antenna is executed by the reactance component of the transmission line.

In the case of the conventional construction in which plural antenna structures operating at different frequencies are integrated together within a small volume, with respect to each of the frequencies, the main portion for radiating an electromagnetic wave is localized, thus making it necessary to arrange plural radiation conductors for radiating plural electromagnetic waves within a small volume so as to cause little mutual interference. This inevitably leads to an increase in the volume of the antenna as a whole.

On the other hand, since the basic operation principle of the antenna according to the present invention is that an electromagnetic wave is radiated into free space in a non-local manner in each of the frequency bandwidths in which the antenna is to be operated, unlike in the prior art, no consideration needs to be given to arrange plural radiation conductors so as not to cause mutual interference due to the electromagnetic wave radiation phenomenon. It is thus possible to form the transmission lines as components of the antenna according to the present invention from linear conductors or narrow strip conductors, and to simply arrange them within a small volume or small dimension.

In the multi-mode antenna according to the present invention, the electromagnetic energy is radiated from the plural transmission lines at respective frequencies without being localized. Accordingly, as compared with the antenna of a structure as disclosed in Document 2 mentioned above in which resonance occurs in different modes (for example, a dipole mode and a loop mode) for each frequency, the multi-mode antenna according to the present invention characteristically includes less portion of the antenna structure that hardly contributes to radiation at the time of electromagnetic wave radiation.

The bandwidth of impedance matching, which is one of important characteristics of an antenna, becomes larger as the total length or dimension of the current pulse of the conductor portion of the multi-mode antenna contributing to the radiation due to the long wavelength effect becomes shorter. The impedance matching of an antenna can be expressed using transmission lines. The electrical property of a transmission line can be described by the factor defined in the equation (1) below using the speed of light c, frequency f, line length L, and propagation constant β.

$$\tan \beta L = \tan \frac{2\pi}{c} fL \tag{1}$$

Further, the frequency derivation of the electrical property of a transmission line indicating the frequency dependence thereof can be represented by the equation (2).

$$\frac{\partial}{\partial f} \tan \frac{2\pi}{c} fL = \frac{2\pi}{c} L \sec^2 \frac{2\pi}{c} fL \tag{2}$$

As represented by the equation (2), the frequency derivation of the electrical property of a transmission line is proportional to the line length L. Accordingly, the longer the line length L, the steeper the change in the impedance with respect to the frequency in the frequency bandwidth where the antenna resonates. As a result, the bandwidth of impedance matching in the same frequency bandwidth becomes narrow. That is, the matching bandwidth decreases due to the long wavelength effect.

According to the present invention, electromagnetic waves are radiated from the transmission lines constituting the antenna at respective frequencies in a non-local manner, whereby unlike the multi-mode antenna of the prior art, a specific transmission line contributes to radiation commonly with respect to plural frequencies, and the presence of this common portion contributes positively to a reduction in the overall length or dimension of the current pathway of the conductor portion of the multi-mode antenna contributing to the radiation. Accordingly, due to the short overall length or dimension of the current pathway as compared with that of the multi-mode antenna of the prior art, the bandwidth can be expanded in the antenna according to the present invention.

The principle of operation of the multi-mode antenna according to the present invention is explained as follows with reference to FIG. 16. Assuming that the number of modes of the multi-mode antenna is n, the wavelength of the electromagnetic wave used is defined as the equation (3).

$$\lambda_1<\lambda_2<\lambda_3<\ldots\lambda_{n-1}<\lambda_n \tag{3}$$

The matching conditions of the antenna can be realized by the susceptance component being cancelled out at the feeding point. In the plural wavelengths in the equation (3), in order to achieve a design that makes the susceptance at the feeding point zero, Si (i=1, 2, . . . , n−1) in FIG. 16 is set as the equation (4).

$$S_i = \frac{\lambda_i}{4},\ i = 1, 2, \cdots\ n-1 \tag{4}$$

Accordingly, when designing the impedance matching at the feeding point at the wavelength $\lambda_1$, the potential at the intersection of Li and Si can be made zero, so there is no need to take the transmission lines $L_{i+1}$ to $L_n$, $S_{i+1}$ to $S_{n-1}$ into consideration.

In order to make the susceptance at the feeding point zero at the wavelength λ1, L1=S1 may be set. The value of L2 for making the susceptance at the feeding point zero at the wavelength λ2 is determined by the equation (5). Here, βi=2π/λi.

$$\cot \beta_2 L_2 = \tan \beta_2 L_1 + \tan \beta_2 S_1 \tag{5}$$

From the equation (4) and the condition L1=S1, the right-hand side of the equation (5) is positive, and the equation (6) is obtained as a result.

$$\beta_2 L_2 < \frac{\pi}{2},\ L_2 < \frac{\lambda_2}{4} \tag{6}$$

The value of L3 for making the susceptance at the feeding point zero at the wavelength λ3 is determined by the equation (7).

$$\cot \beta_3 L_3 = \frac{\tan \beta_3 L_1 + \tan \beta_3 S_1 + \tan \beta_3 L_2}{1 - (\tan \beta_3 L_1 + \tan \beta_3 S_1)\tan \beta_3 L_2} \tan \beta_3 S_2 \tag{7}$$

Since the derivative of the propagation constant in the first term on the right-hand side of the equation (7) results in the equation (8), it is always positive.

$$\frac{L_1 \sec^2 \beta_3 L_1 + S_1 \sec^2 \beta_3 S_1 + L_2 \sec^2 \beta_3 L_2}{\{1 - (\tan \beta_3 L_1 + \tan \beta_3 S_1)\tan \beta_3 L_2\}^2} + \frac{\tan^2 \beta_3 L_2 (L_1 \sec^2 \beta_3 L_1 + S_1 \sec^2 \beta_3 S_1)}{\{1 - (\tan \beta_3 L_1 + \tan \beta_3 S_1)\tan \beta_3 L_2\}^2} + \frac{(\tan \beta_3 L_1 + \tan \beta_3 S_1)^2 L_2 \sec^2 \beta_3 L_2}{\{1 - (\tan \beta_3 L_1 + \tan \beta_3 S_1)\tan \beta_3 L_2\}^2} \tag{8}$$

Since $\beta_3$=0, the equation (3) becomes zero.

Accordingly, since the first term in the equation (7) is positive, and the second term is also positive, the equation (9) is obtained.

$$\beta_3 L_3 < \frac{\pi}{2},\ L_3 < \frac{\lambda_3}{4} \tag{9}$$

Here, the recurrence equation of the equation (10) below having as its first term, the first term on the right-hand side of the equation (7), is introduced.

$$F_2(\beta) = \frac{\tan \beta L_1 + \tan \beta S_1 + \tan \beta L_2}{1 - (\tan \beta L_1 + \tan \beta S_1)\tan \beta L_2},\quad F_{i+1}(\beta) = \frac{F_i(\beta) + \tan \beta S_i + \tan \beta L_{i+1}}{1 - \{F_i(\beta) + \tan \beta S_i\}\tan \beta L_{i+1}} \tag{10}$$

The derivative of the recurrence equation of the equation (10) results in the equation (11).

$$\frac{F_i'(\beta) + S_i \sec^2 \beta S_i + L_{i+1} \sec^2 \beta L_{i+1}}{\{1 - \{F_i(\beta) + \tan \beta S_i)\tan \beta L_{i+1}\}^2} + \frac{\tan^2 \beta L_{i+1}(F_i'(\beta) + S_i \sec^2 \beta S_i)}{\{1 - (F_i(\beta) + \tan \beta S_i)\tan \beta L_{i+1}\}^2} + \frac{(F_i(\beta) + \tan \beta S_i)^2 L_{i+1} \sec^2 \beta L_{i+1}}{\{1 - (F_i(\beta) + \tan \beta S_i)\tan \beta L_{i+1}\}^2} \tag{11}$$

Now, paying attention to the first term in the equation (10), it is appreciated that the equation (11) is always positive.

By using the recurrence equation of the equation (10), the equation (12) for determining Li is obtained.

$$\cot \beta_i L_i = \frac{F_{i-2}(\beta_i) + \tan \beta_i S_{i-2} + \tan \beta_i L_{i-1}}{1 - \{F_{i-2}(\beta_i) + \tan \beta_i S_{i-2})\tan \beta_i L_{i-1}\}} + \tan \beta_i S_{i-1} \tag{12}$$

The right-hand side of the equation (12) is always positive.

Accordingly, the equation (13) is established, so the total length T of the multi-mode antenna according to the present invention shown in FIG. 16 can be expressed by the equation (14).

$$\beta_i L_i < \frac{\pi}{2},\ L_i < \frac{\lambda_i}{4},\ i = 1, 2, \ldots\ n \tag{13}$$

$$T < \frac{\lambda_1}{2} + \frac{\lambda_2}{2} + \frac{\lambda_3}{2} + \ldots + \frac{\lambda_{n-1}}{2} + \frac{\lambda_n}{4} \tag{14}$$

As can be appreciated from the equation (13), in the multi-mode antenna according to the present invention, a quarter wavelength structure of the longest wavelength of the electromagnetic wave of the multi-mode frequency and a half wavelength structure of another wavelength provide the maximum size.

In conventional multi-mode antennas, when such mutually different structures having resonant lengths at respective frequencies are to be realized within an antenna structure, the mutually different structures must be spaced from each other by a distance required for preventing electromagnetic connection therebetween. The present invention obviates such a requirement and thus enables continuous placement. Accordingly, the antenna according to the present invention becomes smaller in dimension than conventional antennas, whereby the frequency bandwidth of impedance matching is enlarged. The equation (13) is an inequality, and in many cases, the antenna according to the present invention can realize a multi-mode antenna by means of a small dimension due to the maximum size condition as mentioned above, thereby further enhancing the effects of reducing the dimension and expanding the bandwidth of matching.

The foregoing description is based on the topology (network structure) shown in FIG. 16. Now, directing attention to two structures shown in FIGS. 17A and 17B, the susceptance Yin thereof can be expressed by each of the equations (15) and (16).

$$Y_{in} = jY_0 \frac{\tan \beta L_a + \tan \beta S_a + \tan \beta L_b}{1 - (\tan \beta L_a + \tan \beta S_a)\tan \beta L_b} \quad (15)$$

$$Y_{in} = jY_0(\tan \beta S_{a1} + \tan \beta S_{a2} + \tan \beta S_{a3}) \quad (16)$$

From the above equations, the conditions for making the susceptance zero are the same between the two structures shown in FIGS. 17A and 17B.

Accordingly, the present invention is obviously applicable not only to the structure shown in FIG. 16 but also to, for example, the topology in which plural open stubs are connected to the portion corresponding to Si.

The topology shown in FIG. 18 represents an example of a three-mode antenna constructed in accordance with the diagram of FIG. 16 illustrating the principle of operation. Further, the topology shown in FIG. 19 represents an example of a four-mode antenna obtained by modifying the principle structure shown in FIG. 16 using the principle shown in FIGS. 17A and 17B.

When a special requirement concerning the real part of the input impedance of the antenna (for example, a requirement such that when the characteristic impedance of a semiconductor device at the front end mounted on the RF board is particularly high or low, to match the real part of the input impedance of the antenna is matched to the characteristic impedance) is made from the RF board side to which the antenna is connected, as in the topology shown in FIG. 20, it proves effective to add a transmission line for performing fine adjustment on the real part of the feeding point for each frequency of the multi-mode with respect to the topology for three modes shown in FIG. 18.

As described in the foregoing, according to the present invention, it is possible to realize an antenna that operates in multiple modes including three or more modes. That is, using a narrow band conductor, a linear conductor, or a narrow strip conductor that can be used as a transmission line, it is possible to design a multi-mode antenna having three modes or more due to the distributed constant circuit theory. Further, the problem of reducing the interference between radiation conductors, which arises in the integration of plural antenna structures as in the prior art, is obviated, which significantly contributes to realizing a compact multi-mode antenna and expanding the frequency bandwidth that is one of important characteristics of the antenna.

The antenna according to the present invention is suitable for use in a portable wireless communication apparatus, in particular, for use in a multimedia wireless terminal of a system for providing multimedia services using plural frequencies.

DETAILED DESCRIPTION OF THE PREFERRED EMBODIMENTS

Figure 1:
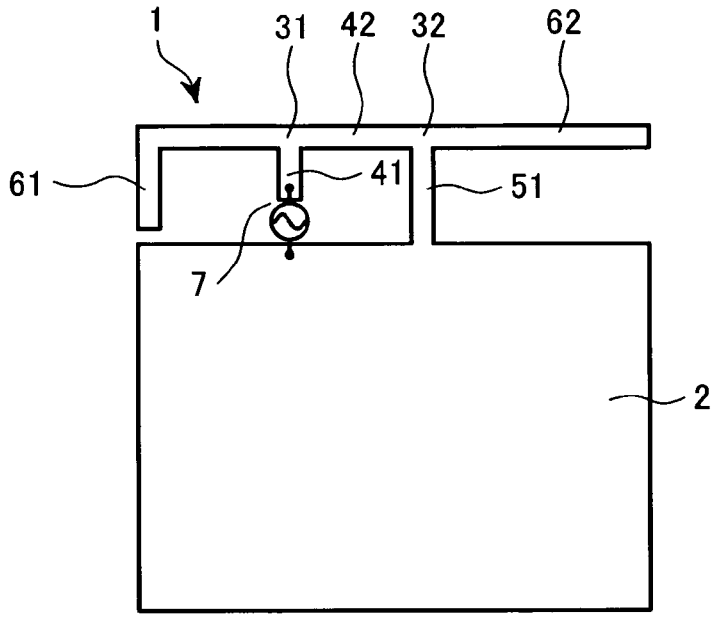
FIG. 1 is a structural diagram illustrating an antenna according to a first embodiment of the present invention.

Hereinbelow, an antenna, a method of manufacturing the antenna, and a portable wireless terminal using the antenna according to the present invention will be described in more detail by way of several embodiments thereof illustrated in the drawings.

FIG. 1 shows a first embodiment of the present invention. This embodiment provides a three-mode antenna. An antenna 1 is composed of a ground conductor (grounding portion) 2, branching points 31, 32, and transmission lines 41, 42, 51, 61, and 62 which are integrated together. A feeding point 7 for supplying electric power is formed between one end of the transmission line 41 and a part of the ground conductor 2. Further, the antenna 1 according to this embodiment consists of an integrated metal plate.

The first branching point 31, which is bifurcated, is connected to the first transmission line 41 that is extended from the feeding point 7 vertically with respect to the ground conductor 2. The first open stub 61 is connected to one end of the first branching point 31, and the second transmission line 42 is connected to the other end of the first branching point 31 while being arranged in parallel to the ground conductor 2. Further, the second branching point 32 that is bifurcated is connected ahead of the second transmission line 42 extending from the first branching point 31. The short stub 51 is connected between one end of the second branching point 32 and the ground conductor 2. The second open stub 62 arranged in parallel to the ground conductor 2 is connected to the other end of the second branching point 32.

The transmission lines 41, 42, the short stub 51, and the open stubs 61, 62, which constitute the antenna 1 according to the present invention, are distributed constant circuit elements. Accordingly, the antenna 1 according to the present invention forms a distributed constant circuit network composed of distributed constant circuits.

In the antenna 1 according to the present invention, a three-mode operation is realized by determining the respective dimensions of the transmission lines 41, 42, short stub 51, and open stubs 61, 62 so that resonance occurs in three different frequency bands in the distributed constant circuit network.

In this embodiment, as an example of a set of three frequencies, the shortest wavelength $\lambda 1$=129.9 mm, the middle wavelength $\lambda 2$=178.0 mm, and the longest wavelength $\lambda 3$=451.1 mm are selected. Further, the lengths of the transmission lines are set as follows: the transmission line 41=20 mm, the transmission line 42=40 mm, the transmission line 51=40 mm, the transmission line 61=80 mm, and the transmission line 62=80 mm. The resulting total transmission line length is 260 mm, which is smaller than $\lambda 1/2+\lambda 2/2+\lambda 3/4$=266.8 mm, so the equation (14) is satisfied.

As shown in FIG. 1, the transmission lines as described above are formed by narrow band conductors. Alternatively, these transmission lines can be formed by linear conductors or narrow strip lines.

Figure 2:
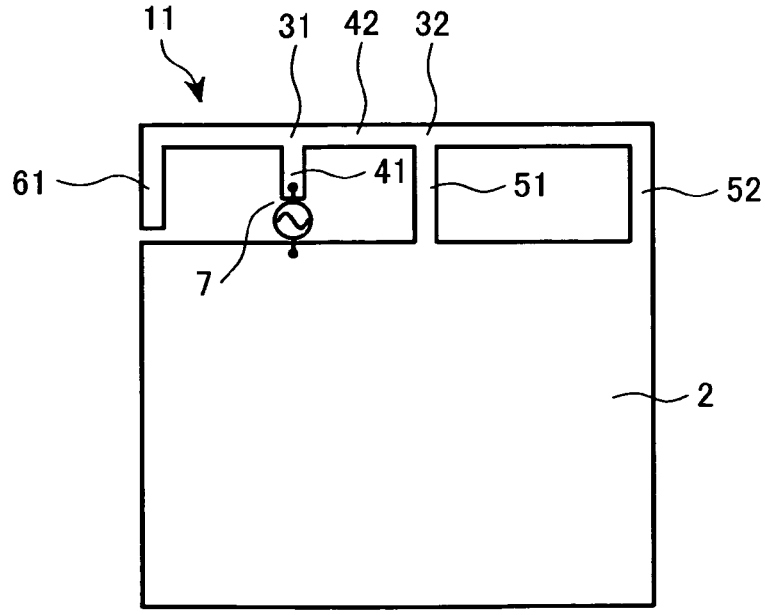
FIG. 2 is a structural diagram illustrating a second embodiment of the present invention.

FIG. 2 shows a second embodiment of the present invention. An antenna 11 shown in FIG. 2 is a three-mode antenna of a structure in which the open stub 62 in the antenna 1 shown in FIG. 1 is replaced by a short stub 52. This structure provides increased mechanical strength as compared with the structure according to the first embodiment.

In this embodiment, as an example of a set of three frequencies, the shortest wavelength $\lambda 1$=85.2 mm, the middle wavelength $\lambda 2$=134.8 mm, and the longest wavelength $\lambda 3$=235.3 mm are selected. Further, the lengths of the transmission lines are set as follows: the transmission line 41=10 mm, the transmission line 42=20 mm, the transmission line 51=20 mm, the transmission line 61=50 mm, and the transmission line 62=50 mm. The resulting total transmission line length is 150 mm, which is smaller than $\lambda 1/2+\lambda 2/2+\lambda 3/4$=168.8 mm, so the equation (14) is satisfied.

Figure 3:
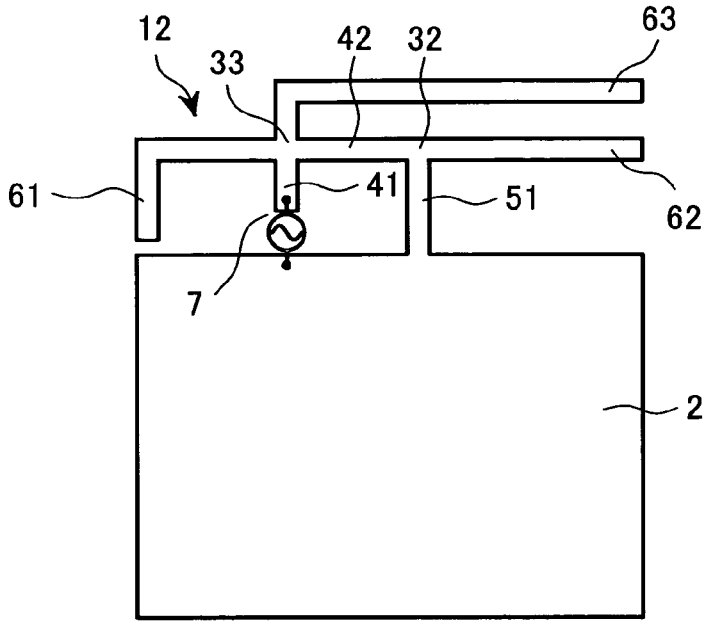
FIG. 3 is a structural diagram illustrating a third embodiment of the present invention.

FIG. 3 shows a third embodiment of the present invention. An antenna 12 shown in FIG. 3 is a three-mode antenna of a structure in which the branching point 31 that is bifurcated in the antenna 1 shown in FIG. 1 is replaced by a branching point 33 that is trifurcated, with another open stub 63 being connected to the branching point 33, thereby increasing the number of elements constituting the antenna.

The structure for increasing the number of elements allows the number of parameters of the distributed constant circuit network to be increased, whereby in addition to the effect of the antenna 1 shown in FIG. 1, it becomes possible to perform fine adjustment on the real part of the antenna input impedance at the feeding point.

In this embodiment, as an example of a set of three frequencies, the shortest wavelength $\lambda 1$=104.7 mm, the middle wavelength $\lambda 2$=219.8 mm, and the longest wavelength $\lambda 3$=322.6 mm are selected. Further, the lengths of the transmission lines are set as follows: the transmission line 41=10 mm, the transmission line 42=20 mm, the transmission line 51=20 mm, the transmission line 61=40 mm, the transmission line 62=40 mm, and the transmission line 63=70 mm. The resulting total transmission line length is 200 mm, which is smaller than $\lambda 1/2+\lambda 2/2+\lambda 3/4$=243 mm, so the equation (14) is satisfied.

Figure 4:
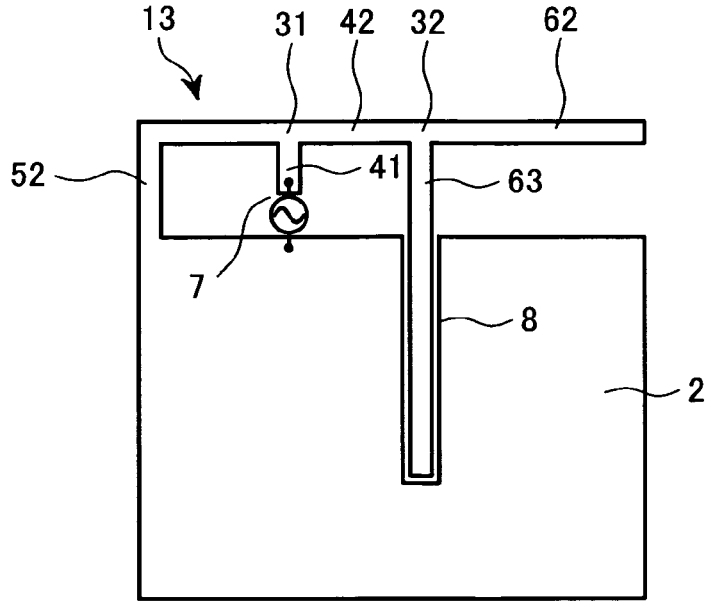
FIG. 4 is a structural diagram illustrating a fourth embodiment of the present invention.

FIG. 4 shows a fourth embodiment of the present invention. An antenna 13 shown in FIG. 4 is a three-mode antenna of a structure in which a groove 8 is formed in a part of the ground conductor 2, with the open stub 63 being received within the groove 8.

In FIG. 4, the branching point 31 that is bifurcated is connected to the first transmission line 41 extended from the feeding point 7 vertically with respect to the ground conductor 2. The short stub 52 is formed between one end of the first branching point 31 and the ground conductor 2. The second transmission line 42 is connected to the other end of the first branching point 31 so as to be parallel to the ground conductor 2. Further, the second branching point 32 that is bifurcated is connected ahead of the second transmission line 42 extending from the first branching point 31. The first open stub 62 is connected to one end of the second branching point 32 so as to be parallel to the ground conductor 2. The second open stub 63, which is extended vertically toward the ground conductor and put within the groove 8 of the ground conductor 2 and is longer in dimension than the first open stub 62, is connected to the other end of the second branching point.

In this embodiment, as an example of a set of three frequencies, the shortest wavelength $\lambda 1$=80.4 mm, the middle wavelength $\lambda 2$=103.8 mm, and the longest wavelength $\lambda 3$=397.4 mm are selected. Further, the lengths of the transmission lines are set as follows: the transmission line 41=10 mm, the transmission line 42=20 mm, the transmission line 52=30 mm, the transmission line 62=40 mm, and the transmission line 63=60 mm, and the transmission line 63=60 mm. The resulting total transmission line length is 160 mm, which is smaller than $\lambda 1/2+\lambda 2/2+\lambda 3/4$=191.5 mm, so the equation (14) is satisfied.

With this structure, when the length of the open stub 63 is long, the mechanical strength of the antenna itself can be increased as compared with the case where the open stub 63 is arranged so as to surround the entire antenna.

It should be noted that when the same occurs in a short stub, the same effect as described above can be obtained also by connecting the short stub so as to be put within the groove of the ground conductor in the same manner as the open stub 63 of the antenna 13 according to the present invention.

Figure 5A:
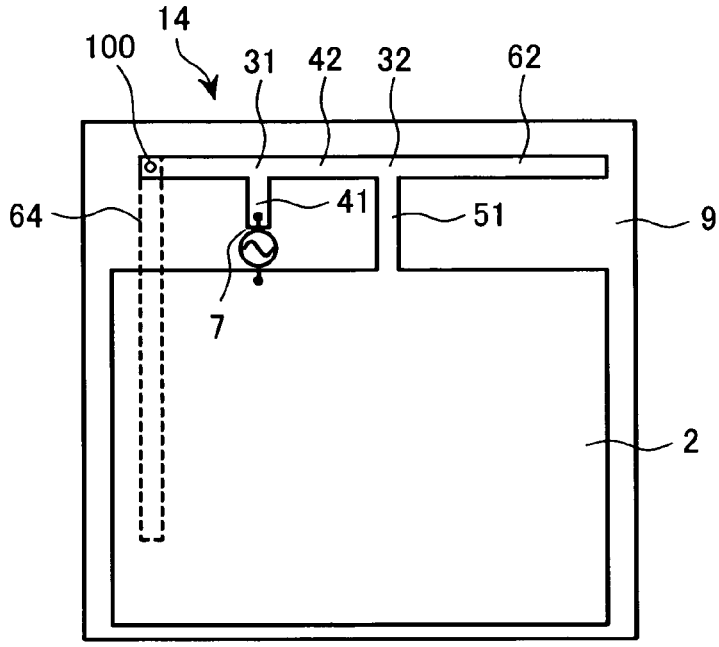
FIG. 5A is a structural diagram illustrating a fifth embodiment of the present invention.
Figure 5B:
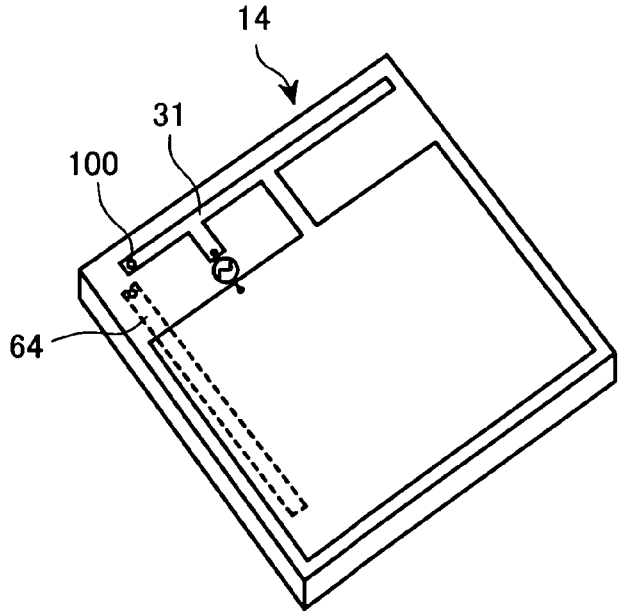
FIG. 5B is a perspective view illustrating the fifth embodiment of the present invention.

FIGS. 5A, 5B show a fifth embodiment of the present invention. An antenna 14 shown in FIGS. 5A, 5B is a three-mode antenna of a structure in which an antenna structure of an integrated metal plate is supported by a dielectric layer, with a strip conductor pattern being formed on the back-side portion of this integrated metal plate. According to this structure, in order to replace the first open stub 61, which is connected to one end of the first branching point 31 that is bifurcated in the antenna 1 shown in FIG. 1, by an open stub 64 that is longer in dimension than the open stub 61, using a through-hole 100 provided in the dielectric layer 9, the open stub 64 is formed in a surface different from one surface of the dielectric layer 9.

This structure provides the effect of reducing the antenna size due to the wavelength-shortening effect of the dielectric rate of the dielectric layer.

Figure 6A:
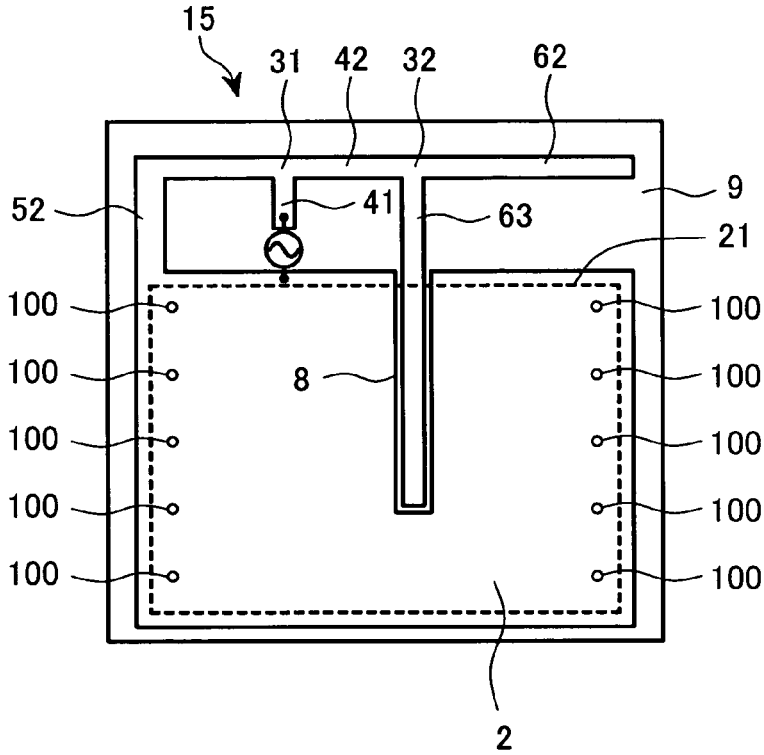
FIG. 6A is a structural diagram illustrating a sixth embodiment of the present invention.
Figure 6B:
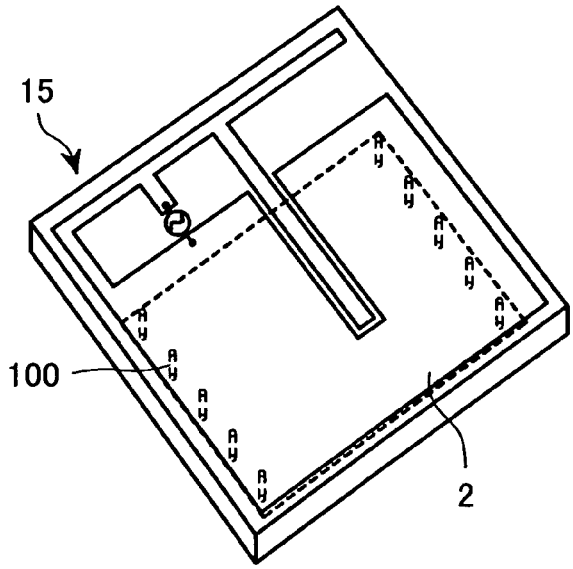
FIG. 6B is a perspective view illustrating the sixth embodiment of the present invention.

FIGS. 6A, 6B show a sixth embodiment of the present invention. An antenna 15 shown in FIGS. 6A, 6B forms a three-mode antenna. The antenna 15 is of a structure in which the antenna 13 according to the present invention shown in FIG. 4 is supported by the dielectric layer 9, a second ground conductor 21 is formed on the other surface of the dielectric layer 9 using plural through-holes 100, which extend through the dielectric layer 9 from the ends of the ground conductor 2 of the antenna 13 to reach the back-side portion of the antenna 13, and the second ground conductor 12 and the ground conductor 2 of the antenna 13 are connected to each other.

With this structure, the antenna size is reduced due to the wavelength-shortening effect of the dielectric rate of the dielectric material forming the circuit board, and the surface area of the ground conductor is increased, thereby stabilizing the operation of the antenna.

Figure 7A:
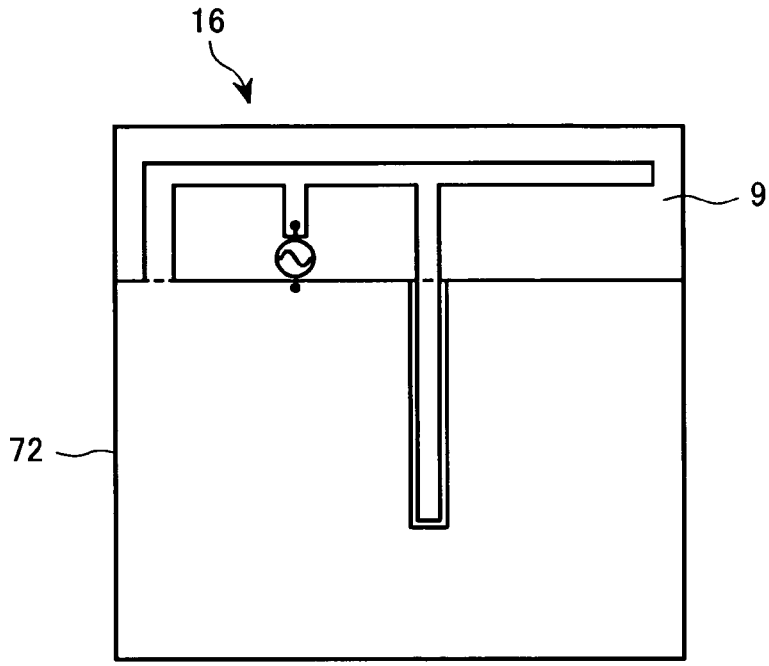
FIG. 7A is a structural diagram illustrating a seventh embodiment of the present invention.
Figure 7B:
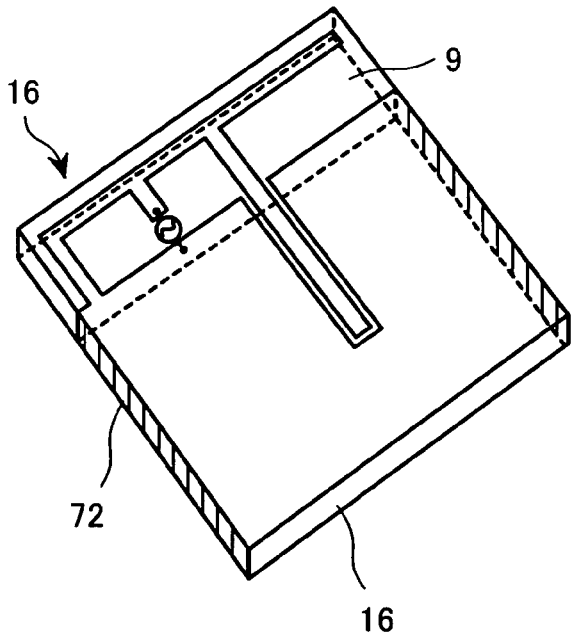
FIG. 7B is a perspective view illustrating the seventh embodiment of the present invention.

FIGS. 7A, 7B show a seventh embodiment of the present invention. An antenna 16 shown in FIGS. 7A, 7B is a three-mode antenna of a structure in which a plating area 72 formed on a side surface of the dielectric layer is used for the connection between the ground conductor 2 of the antenna 13 shown in FIG. 4 formed on one surface of the dielectric later 9 and the ground conductor 21 formed on the other surface of the dielectric layer 9.

This structure saves the trouble of preparing the through-hole adopted in the sixth embodiment, whereby the same effect as that of the sixth embodiment can be attained at reduced manufacturing cost.

Figure 8:
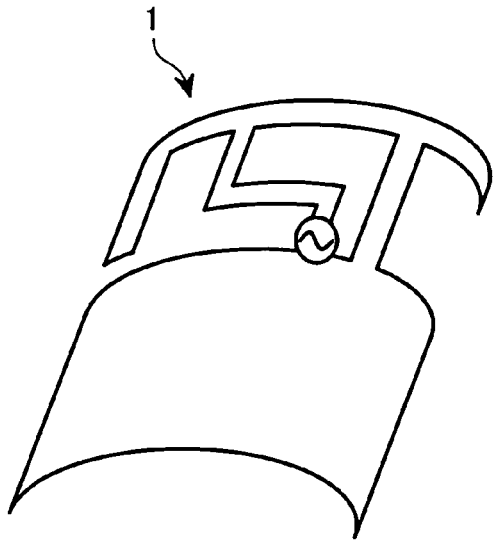
FIG. 8 is a structural diagram illustrating an eighth embodiment of the present invention.

FIG. 8 shows an eighth embodiment of the present invention. In this embodiment, the entire structure of the antenna 1 shown in FIG. 1 is curved so as to impart roundness to the structure. The structure of this embodiment can be produced at low cost by first producing the antenna structure shown in FIG. 1 by punching press working, followed by bending press working.

According to the antenna structure of this embodiment, when the internal configuration of the chassis of the wireless terminal to which the antenna is mounted is curved, the volume that can be occupied by the antenna within the chassis can be substantially increased, so the degree of freedom of the antenna design increases to thereby achieve shortening of the design process.

Figure 9:
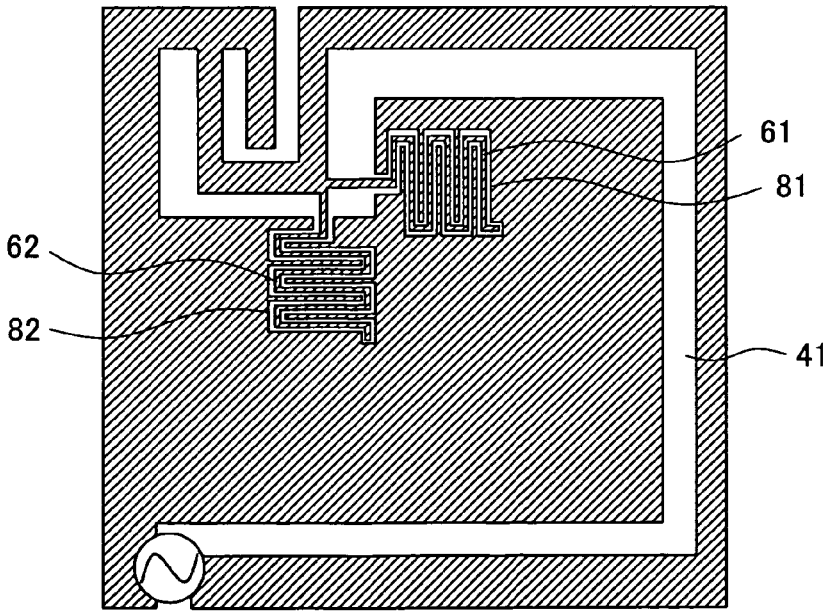
FIG. 9 is a structural diagram illustrating a ninth embodiment of the present invention.

FIG. 9 shows a ninth embodiment of the present invention. As shown in FIG. 9, an antenna of this embodiment is a three-mode antenna obtained by elongating the transmission line 41 of the antenna structure shown in FIG. 1. In order to secure the length of the transmission line 41, the transmission line 41 is formed along the periphery of the ground conductor 2. Further, the open stubs 61, 62 are provided in meander grooves 81, 82 formed within the ground conductor, respectively.

With the construction of this embodiment, when the total length of the transmission lines constituting the antenna is long, the formation of these transmission lines can be realized within a small dimension. The same technique can of course be applied to the short stubs.

Figure 10:
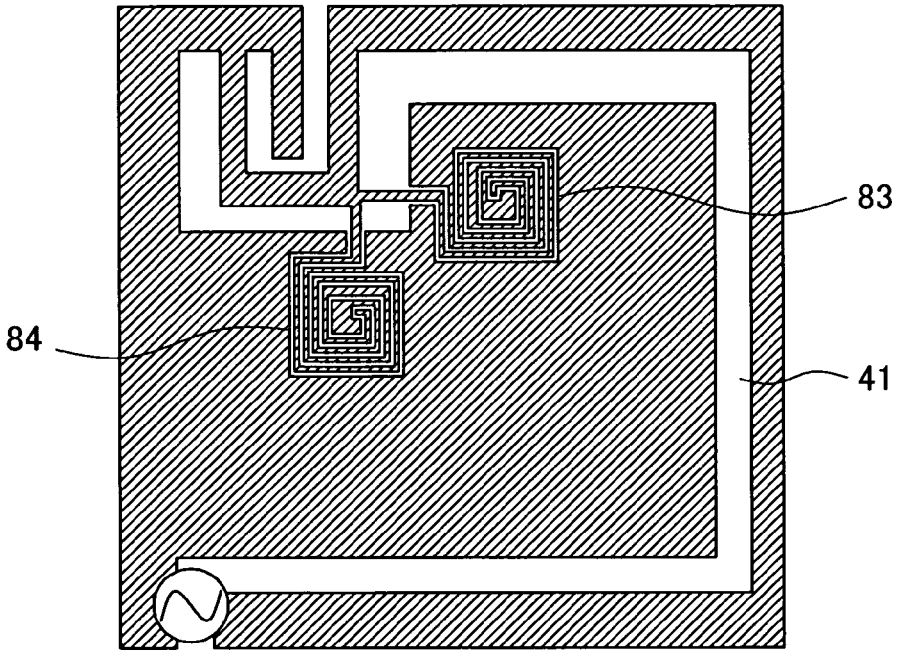
FIG. 10 is a structural diagram illustrating a tenth embodiment of the present invention.

FIG. 10 shows a tenth embodiment of the present invention. This embodiment differs from the embodiment shown in FIG. 9 in that grooves 83, 84 for realizing the formation of the open stubs within the ground conductor have a square spiral configuration. The spiral configuration allows an increase in inductance component, thereby making it possible to achieve an equivalent reduction in the physical length of the open stubs. The surface area of the ground conductor is thus increased, thereby achieving an improvement in the stability of the antenna operation.

Figure 11:
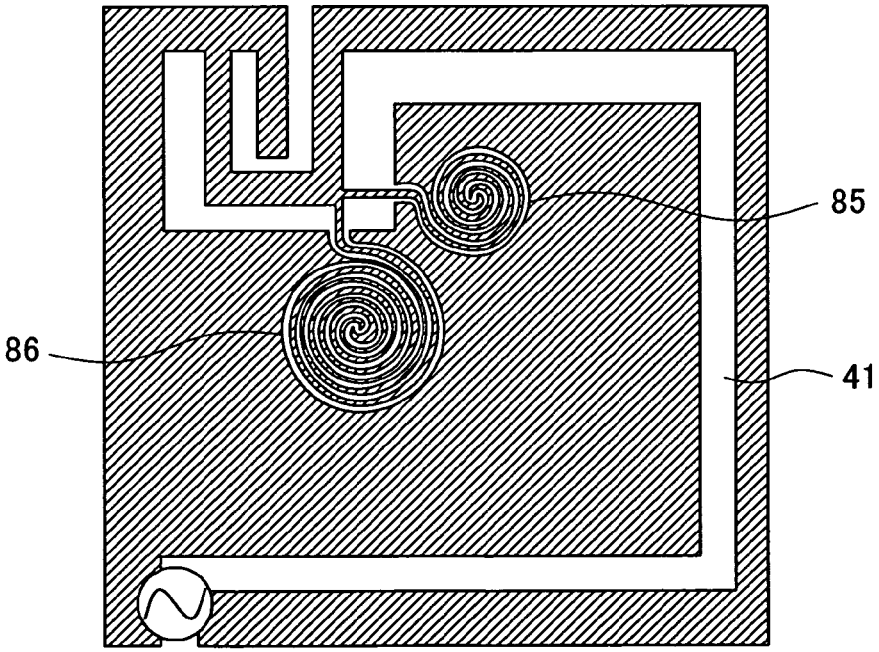
FIG. 11 is a structural diagram illustrating an eleventh embodiment of the present invention.

FIG. 11 shows an eleventh embodiment of the present invention. This embodiment differs from the embodiment shown in FIG. 10 in that grooves 85, 86 for realizing the formation of the open stubs within the ground conductor have a circular spiral configuration. Since the circular spiral configuration involves less structural discontinuity as compared with the square spiral configuration, it is possible to reduce variations in electrical characteristics with respect to the dimensional accuracy of the spiral configuration. This allows an improvement in manufacturing yield and, as a result, a reduction in the manufacturing cost of the obtained antenna product.

Figure 12:
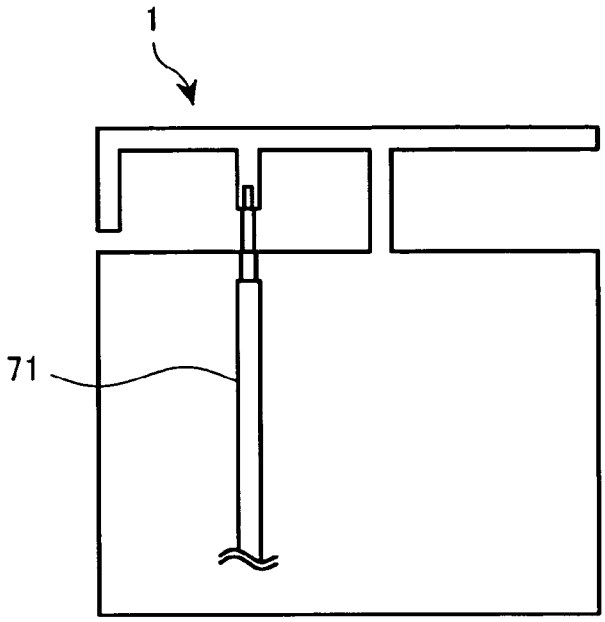
FIG. 12 is a structural diagram illustrating a twelfth embodiment of the present invention.

FIG. 12 shows a twelfth embodiment of the present invention. This embodiment uses a coaxial cable for feeding electric power. As shown in FIG. 12, a coaxial cable 71 is connected to the feeding point 7 of the antenna 1 shown in FIG. 1, and electric power is supplied via the coaxial cable 71.

Characteristically, a coaxial cable exhibits low transmission loss in high-frequency bands and thus enables efficient supply of electric power to the antenna. Further, the use of the coaxial cable enables connection to a communication module or the like placed at a remote location from the antenna, thereby affording a greater degree of freedom in terms of the installation location of the antenna.

Figure 13:
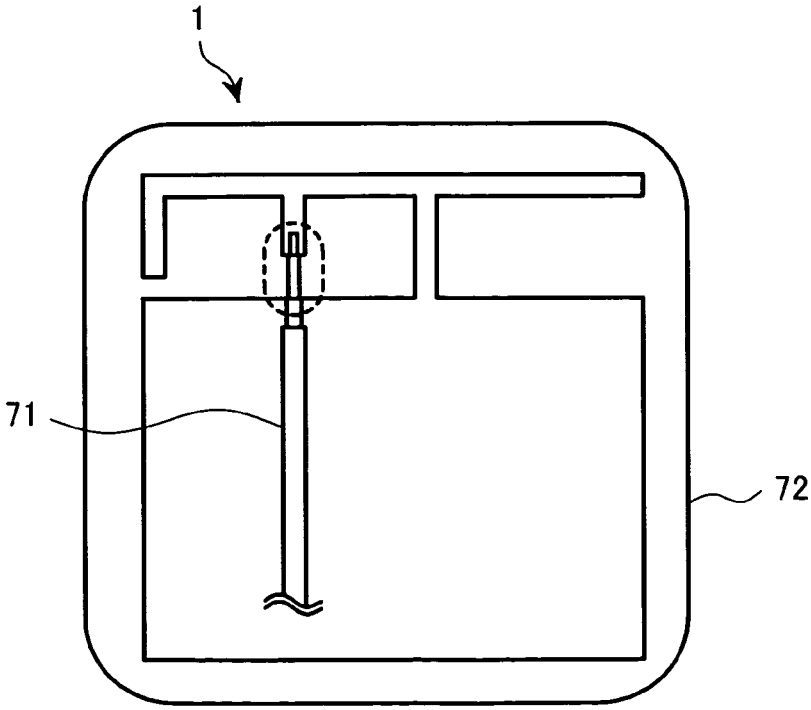
FIG. 13 is a structural diagram illustrating the product structure according to the twelfth embodiment.

FIG. 13 shows an example of the product structure of the antenna shown in FIG. 12, in which the coaxial feeding line 71 is provided to the antenna 1 shown in FIG. 1. The antenna shown in FIG. 13 includes the coaxial feeding line shown in FIG. 12 as its component. A thin dielectric sheet 72 is laminated over the entire antenna, excluding the junction between the coaxial feeding line and the feeding point of the antenna. A polyimide-based material, for example, may be used for the dielectric sheet. It is desirable that at the junction between the coaxial feeding line and the feeding point of the antenna, the conductors constituting the antenna be exposed only to such an extent that the transmission lines including an outer conductor of the coaxial cable, the ground conductor of the antenna, an inner conductor of the coaxial cable, and the feeding point of the antenna can be subjected to electrical connection such as soldering in a post-process, and that the other conductor portions of the antenna be covered by the dielectric sheet as much as possible to prevent degradation due to external factors.

According to this embodiment, by adopting the product structure as shown in FIG. 13, the antenna is prevented from coming into contact with other electronic/electrical components within the chassis of the wireless terminal, and also the integrated metal plate forming the antenna is prevented from undergoing erosion, degradation, or the like due to external factors, thereby improving the temporal stability (secular change) of the antenna characteristics.

Figure 14A:
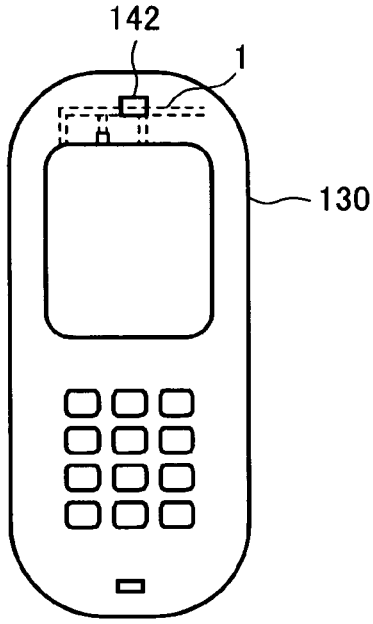
FIG. 14A is a front view illustrating a thirteenth embodiment of the present invention.
Figure 14B:
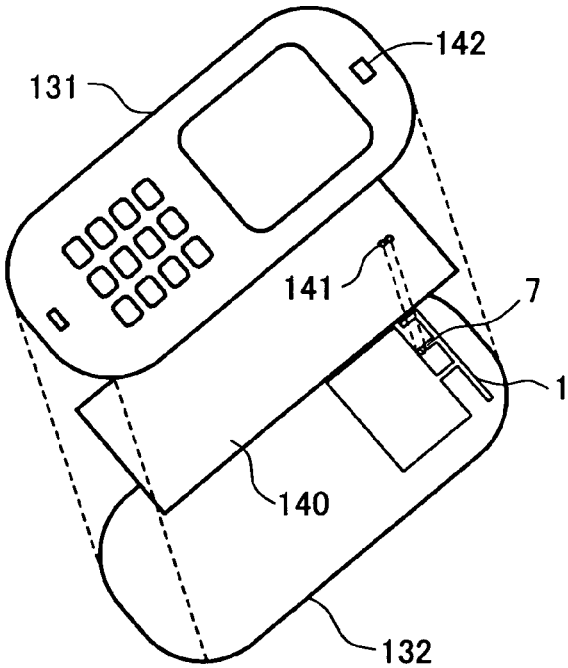
FIG. 14B is an exploded view illustrating the thirteenth embodiment of the present invention.

FIGS. 14A, 14B show a thirteenth embodiment of the present invention. In FIGS. 14A, 14B, reference numeral 130 denotes a handy phone (portable wireless terminal) incorporating the multi-mode antenna 1 according to the present invention as shown in FIG. 1, and reference numeral 142 denotes a speaker of the handy phone 130.

In FIG. 14B, a circuit board 140 is arranged between a front cover 131 and a back cover 132 of the handy phone 130. The multi-mode antenna 1 according to the present invention is placed at a position between the circuit board 140 and the back cover 132 and in rear of the speaker 142, that is, at an upper-side position of the main body. A feeding point 141 of a high-frequency circuit is placed in the circuit board 140. The feeding point 141 and the feeding point 7 of the multi-mode antenna 1 according to the present invention are connected to each other.

When using the handy phone, in the majority of cases, the hand of the user does not reach an upper back-side portion of the main body of the handy phone. Accordingly, by building the antenna in the handy phone at a position in an upper back-side portion of the main body of the handy phone, no degradation occurs in the transmission/reception sensitivity of the antenna due to the hand of the user.

Currently, image services are increasingly becoming important applications in multimedia wireless terminals. With the development of image services, there is a trend toward larger size of the display such as a liquid crystal display used in a wireless terminal. The trend is particularly remarkable in the case of a portable wireless phone whose terminal volume itself is small. The necessity to realize a large image screen with a terminal having a small volume has led to the increasing adoption of a folding type chassis structure. Since such a folding type structure practically imposes severe restrictions on the antenna-mounting space with respect to the thickness direction, the adaptability of the multi-mode antenna according to the present invention having a thin sheet-like configuration to the folding type structure is extremely high. By adopting the multi-mode antenna according to the present invention for the folding type chassis of a multimedia terminal equipped with a large display portion, it is possible to mount the antenna on the back side of the large display portion.

It should be noted that while the multi-mode antenna 1 according to the first embodiment is mounted in the handy phone of this embodiment, this should not be construed restrictively. Any one of the antennas according to the second to twelfth embodiments can be mounted in the handy phone.

Figure 15A:
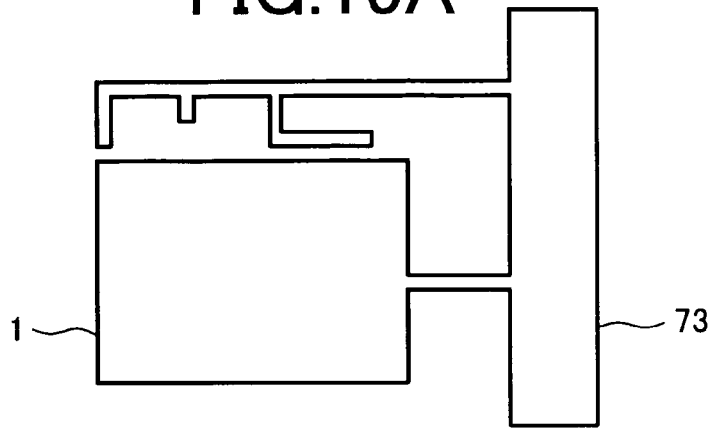
FIG. 15A is a structural diagram illustrating a first manufacturing process according to a fourteenth embodiment of the present invention, FIG. 15B a structural diagram illustrating a second manufacturing process according to the fourteenth embodiment of the present invention.
Figure 15B:
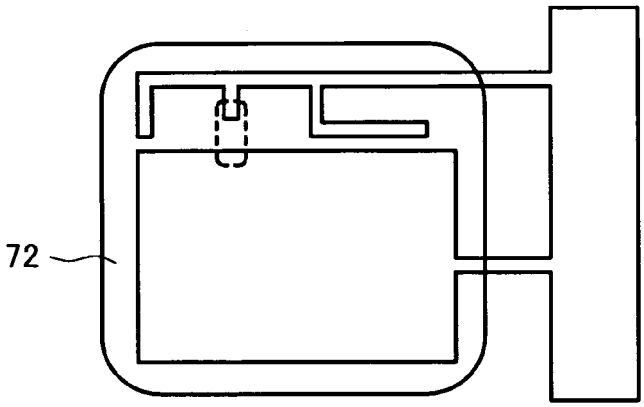
FIG. 15C is a structural diagram illustrating a third manufacturing process according to the fourteenth embodiment of the present invention.
Figure 15C:
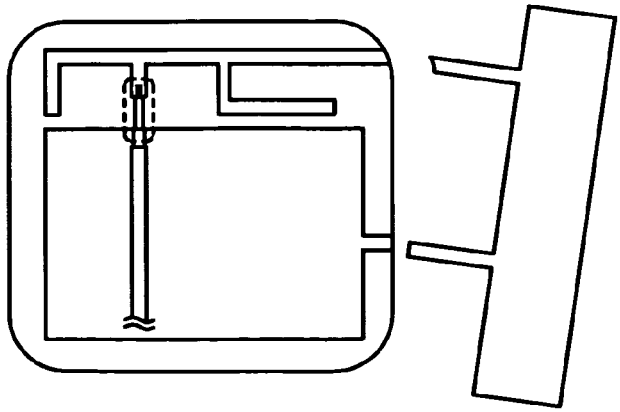
Figure 16:
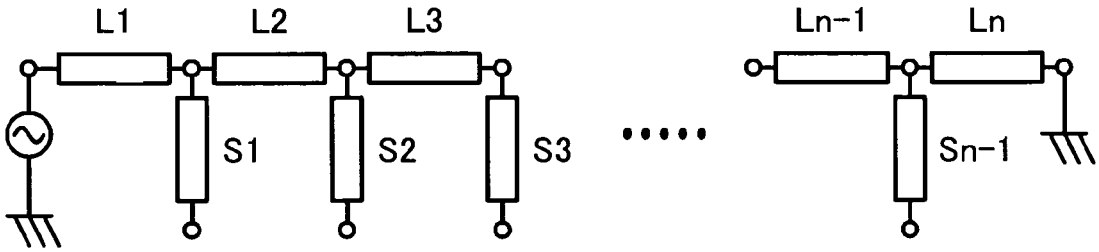
FIG. 16 is a structural diagram illustrating the principle of the antenna according to the present invention.
Figure 17A:
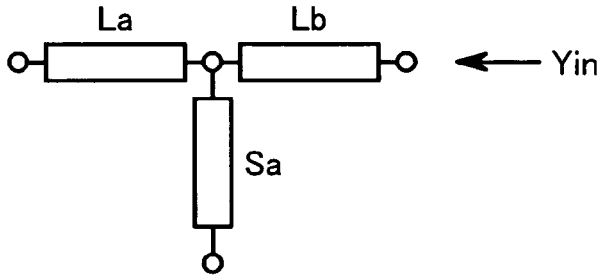
FIG. 17A is a structural diagram illustrating a portion of the antenna according to the present invention.
Figure 17B:
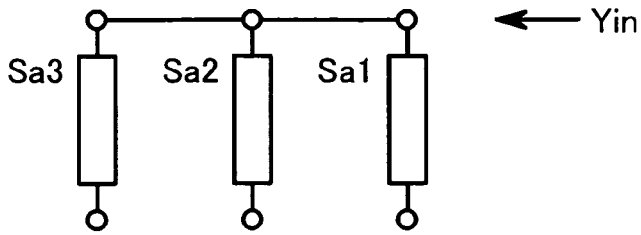
FIG. 17B is a structural diagram illustrating another portion of the antenna according to the present invention.
Figure 18:
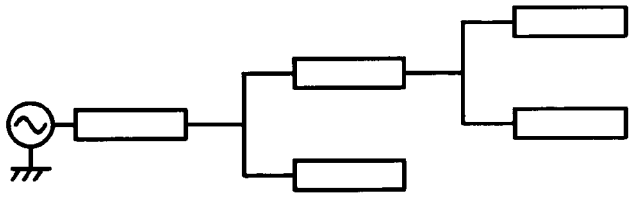
FIG. 18 is a structural diagram illustrating a topology (network structure) of the antenna according to the present invention.
Figure 19:
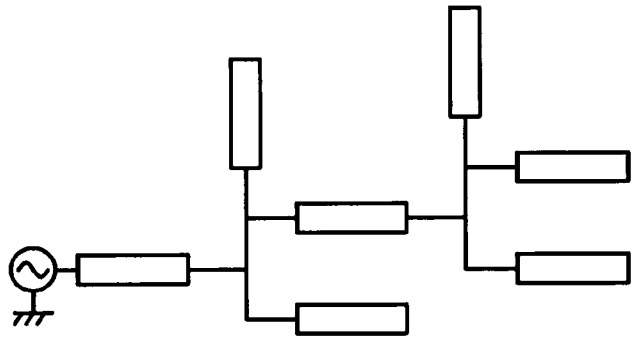
FIG. 19 is a structural diagram illustrating another topology (network structure) of the antenna according to the present invention.
Figure 20:
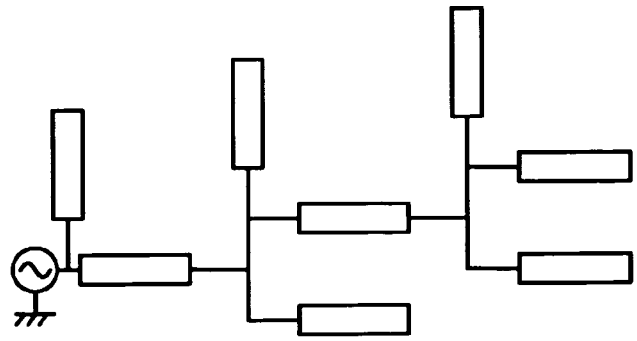
FIG. 20 is a structural diagram illustrating still another topology (network structure) of the antenna according to the present invention.

FIGS. 15A to 15C show a fourteenth embodiment of the present invention. An embodiment of a multi-mode antenna manufacturing method according to the present invention is illustrated in the drawings. This embodiment is directed to the manufacturing method in the case where the transmission lines as the components of the antenna include no short stub, or where a sufficient physical strength cannot be secured for the junction between the short stub and the ground conductor.

First, as shown in FIG. 15A, the entire antenna structure is produced by a metal press punching process integrally with a supporting conductor 73 for securing the physical strength of the junction between the series of integrated transmission line portions and the ground conductor.

Next, as shown in FIG. 15B, the entire portion excluding the feeding point of the antenna and the supporting conductor is covered through a lamination process using the thin dielectric sheet 72.

Subsequently, as shown in FIG. 15C, by performing the metal press punching process again, the supporting conductor, which is essentially unnecessary for the antenna operation, is cut off. Lastly, the coaxial cable is assembled through plating process, thereby completing the manufacture of the antenna as the final product.

By employing the technique according to this embodiment, the antenna can be manufactured with high accuracy in terms of the relative positional relation between the ground conductor and the transmission line. As a result, an improvement is achieved in terms of the manufacturing yield.

As described in the foregoing, according to the present invention, impedance matching between the RF circuit portion and the free space can be performed using a transmission line by means of a single feeding point at plural frequencies, thereby making it possible to realize an antenna that operates in multiple modes including three or more modes. Further, it is possible to realize a structure in which the transmission line is shared among plural frequencies, which provides a significant effect in reducing the size of the multi-mode antenna and increasing the matching bandwidth of the multi-mode antenna.

What is claimed is:

1. An antenna comprising:

a ground conductor having a ground potential;

a single feeding point whose one end is formed by a part of the ground conductor; and a plurality of transmission lines to which RF power supplied to the feeding point is input, for radiating electromagnetic waves of a plurality of frequencies into space, wherein the plurality of transmission lines include a specific transmission line that consists of a single element without being separated by space to radiate electromagnetic waves of the plurality of frequencies into space commonly to the plurality of frequencies, wherein the number of the plurality of transmission lines is equal to or more than four, wherein impedance matching is performed at the feeding point with respect to the plurality of frequencies, and wherein the plurality of frequencies are composed of n frequencies of first, second, third and fourth to n-th frequencies, where n is a positive integer of two or more, and wherein the total length of the plurality of transmission lines is shorter than the sum of a quarter wavelength of an electromagnetic wave of the first frequency and half wavelengths of electromagnetic waves of the second, third and fourth to n-th frequencies, the second, third and fourth to n-th frequencies being higher than the first frequency.

2. The antenna according to claim 1, wherein the ground conductor, the feeding point and the plurality of transmission lines are formed of an integrated metal plate.

3. The antenna according to claim 1, wherein the ground conductor is located on one side of one of the plurality of transmission lines.

4. An antenna comprising:

a ground conductor having a ground potential;

a single feeding point whose one end is formed by a part of the ground conductor; and a plurality of transmission lines to which RF power supplied to the feeding point is input, for radiating electromagnetic waves of a plurality of frequencies into space, wherein the plurality of transmission lines include a specific transmission line that consists of a single element without being separated by space to radiate electromagnetic waves of the plurality of frequencies into space commonly to the plurality of frequencies, wherein the number of the plurality of transmission lines is equal to or more than four, wherein, when the plurality of frequencies are composed of two frequencies of first and second frequencies, the plurality of transmission lines include a first transmission line whose one end is connected to the feeding point and whose other end is connected to a first branching point, and a second transmission line connected to the first branching point, wherein respective lengths of the plurality of transmission lines are set so that impedance matching is performed at the feeding point with respect to the plurality of frequencies, and wherein the total length of the plurality of transmission lines is shorter than the sum of a quarter wavelength of an electromagnetic wave of the first frequency and a half wavelength of an electromagnetic wave of the second frequency, the second frequency being higher than the first frequency.

5. The antenna according to claim 4, wherein the ground conductor, the feeding point and the plurality of transmission lines are formed of an integrated metal plate.

6. The antenna according to claim 4, wherein the ground conductor is located on one side or one of the plurality of transmission lines.

7. The antenna according to claim 4, further comprising a transmission line for impedance adjustment connected to at least one of the feeding point and the branching point.

8. A portable wireless terminal comprising an antenna incorporated therein, the antenna comprising:

a ground conductor having a ground potential;

a single feeding point whose one end is formed by a part of the ground conductor; and a plurality of transmission lines to which RF power supplied to the feeding point is input, for radiating electromagnetic waves of a plurality of frequencies into space, wherein the plurality of transmission lines include a specific transmission line that consists of a single element without being separated by space to radiate electromagnetic waves of the plurality of frequencies into space commonly to the plurality of frequencies, wherein the number of the plurality of transmission lines is equal to or more than four, wherein, when the plurality of frequencies are composed of two frequencies of first and second frequencies, the plurality of transmission lines include a first transmission line whose one end is connected to the feeding point and whose other end is connected to a first branching point, and a second transmission line connected to the first branching point, wherein respective lengths of the plurality of transmission lines are set so that impedance matching is performed at the feeding point with respect to the plurality of frequencies, and wherein the total length of the plurality of transmission lines is shorter than the sum of a quarter wavelength of an electromagnetic wave of the first frequency and a half wavelength of an electromagnetic wave of the second frequency, the second frequency being higher than the first frequency.

9. An antenna comprising:

a ground conductor having a ground potential;

a single feeding point whose one end is formed by a part of the ground conductor; and a plurality of transmission lines to which RF power supplied to the feeding point is input, for radiating electromagnetic waves of a plurality of frequencies into space, wherein the plurality of transmission lines include a specific transmission line that consists of a single element without being separated by space to radiate electromagnetic waves of the plurality of frequencies into space commonly to the plurality of frequencies, wherein the number of the plurality of transmission lines is equal to or more than four, wherein, when the plurality of frequencies are composed of n frequencies of first, second, third and fourth to n-th frequencies, where n is a positive integer of three or more, the plurality of transmission lines include a first transmission line whose one end is connected to the feeding point and whose other end is connected to a first branching point, a second transmission line connected between the first branching point and a second branching point, and a third transmission line connected to the second branching point, wherein respective lengths of the plurality of transmission lines are set so that impedance matching is performed at the feeding point with respect to the plurality of frequencies, and wherein the total length of the plurality of transmission lines is shorter than the sum of a quarter wavelength of an electromagnetic wave of the first frequency and each of half wavelengths of electromagnetic waves of the second, third and fourth to n-th frequencies, the second, third and fourth to n-th frequencies being higher than the first frequency.

10. The antenna according to claim 9, wherein the ground conductor, the feeding point and the plurality of transmission lines are formed of an integrated metal plate.

11. The antenna according to claim 9, wherein the ground conductor is located on one side of one of the plurality of transmission lines.

12. The antenna according to claim 9, further comprising a transmission line for impedance adjustment connected to at least one of the feeding point and the branching point.

13. A portable wireless terminal comprising an antenna incorporated therein, the antenna comprising:

a ground conductor having a ground potential;

a single feeding point whose one end is formed by a part of the ground conductor; and a plurality of transmission lines to which RF power supplied to the feeding point is input, for radiating electromagnetic waves of a plurality of frequencies into space, wherein the plurality of transmission lines include a specific transmission line that consists of a single element without being separated by space to radiate electromagnetic waves of the plurality of frequencies into space commonly to the plurality of frequencies, wherein the number of the plurality of transmission lines is equal to or more than four, wherein, when the plurality of frequencies are composed of n frequencies of first, second, third and fourth to n-th frequencies, where n is a positive integer of three or more, the plurality of transmission lines include a first transmission line whose one end is connected to the feeding point and whose other end is connected to a first branching point, a second transmission line connected between the first branching point and a second branching point, and a third transmission line connected to the second branching point, wherein respective lengths of the plurality of transmission lines are set so that impedance matching is performed at the feeding point with respect to the plurality of frequencies, and wherein the total length of the plurality of transmission lines is shorter than the sum of a quarter wavelength of an electromagnetic wave of the first frequency and half wavelengths of electromagnetic waves of the second, third and fourth to n-th frequencies, the second, third and fourth to n-th frequencies being higher than the first frequency.

* * * * *